US009640377B2

(12) United States Patent
Xu et al.

(10) Patent No.: US 9,640,377 B2
(45) Date of Patent: May 2, 2017

(54) METHOD FOR TANDEM MASS SPECTROMETRY ANALYSIS IN ION TRAP MASS ANALYZER

(71) Applicant: FUDAN UNIVERSITY, Shanghai (CN)

(72) Inventors: Fuxing Xu, Shanghai (CN); Liang Wang, Shanghai (CN); Chuanfan Ding, Shanghai (CN)

(73) Assignee: Fudan University (CN)

( * ) Notice: Subject to any disclaimer, the term of this patent is extended or adjusted under 35 U.S.C. 154(b) by 0 days.

(21) Appl. No.: 14/905,912

(22) PCT Filed: Jul. 4, 2014

(86) PCT No.: PCT/CN2014/081622
§ 371 (c)(1),
(2) Date: Sep. 1, 2016

(87) PCT Pub. No.: WO2015/007165
PCT Pub. Date: Jan. 22, 2015

(65) Prior Publication Data

US 2016/0365231 A1 Dec. 15, 2016

(30) Foreign Application Priority Data

Jul. 18, 2013 (CN) ..... 2013 1 0303472

(51) Int. Cl.
*H01J 49/00* (2006.01)
*H01J 49/42* (2006.01)

(52) U.S. Cl.
CPC ..... *H01J 49/0081* (2013.01); *H01J 49/0031* (2013.01); *H01J 49/0063* (2013.01); *H01J 49/427* (2013.01)

(58) Field of Classification Search
CPC ..... H01J 49/0081; H01J 49/0031; H01J 49/0063; H01J 49/427
See application file for complete search history.

(56) References Cited

U.S. PATENT DOCUMENTS 8,178,835 B2 * 5/2012 Remes ..... H01J 49/005 250/282
2007/0158545 A1 * 7/2007 Verentchikov ..... H01J 49/004 250/282

(Continued)

FOREIGN PATENT DOCUMENTS

CN 101320016 12/2008
CN 102169791 8/2011

(Continued)

OTHER PUBLICATIONS

International Search Report of corresponding PCT/CN2014/081622.

(Continued)

*Primary Examiner* — Nicole Ippolito
*Assistant Examiner* — Sean Luck
(74) *Attorney, Agent, or Firm* — Berenato & White, LLC

(57) ABSTRACT

This invention is related to a tandem mass spectrometric analysis method in ion trap mass analyzer. Such method comprise three stages as represented by selective isolation, collision induced disassociation and mass scanning of ion. At the collision induced isolation stage, this invention is expected to endow parent ion of certain mass-charge ratio with energy through resonance excitation by changing cycle of radio frequency signals, namely frequency of radio frequency voltage imposed on the ion trap; such high-energy ions produced through resonance excitation are to be disassociated through collision with neutral molecules in the ion trap, which will further generate product ion to realize tandem mass spectrometric analysis. Advantage of this (Continued)

method lies in the fact that it can realize collision induced disassociation by changing scanning cycle at the stage of collision induced disassociation stage through software configuration, which can significantly simplify experimental devices and methods for tandem mass spectrometric analysis.

8 Claims, 4 Drawing Sheets

(56) References Cited

U.S. PATENT DOCUMENTS

| | | | | |
|---|---|---|---|---|
| 2009/0194684 | A1* | 8/2009 | Guna | H01J 49/426 250/282 |
| 2010/0065733 | A1* | 3/2010 | Bateman | H01J 49/004 250/282 |
| 2010/0084552 | A1 | 4/2010 | Kawana | |
| 2011/0309244 | A1* | 12/2011 | Whitehouse | H01J 49/063 250/287 |
| 2012/0292498 | A1 | 11/2012 | Jiang et al. | |

FOREIGN PATENT DOCUMENTS

| | | |
|---|---|---|
| CN | 102937622 | 2/2013 |
| CN | 103413751 | 11/2013 |

OTHER PUBLICATIONS

B.M. Prentice et al, "Dipolar DC Collisional Activation in a "Stretched" 3-D Ion Trap: The Effect of Higher Order Fields on rf-Heating", Journal of the American Society for Mass Spectrometry, Apr. 2012, vol. 23(4), pp. 736-744.

* cited by examiner

METHOD FOR TANDEM MASS SPECTROMETRY ANALYSIS IN ION TRAP MASS ANALYZER

CROSS-REFERENCE TO RELATED APPLICATIONS AND CLAIM TO PRIORITY

This application is a National Phase of International Application No. PCT/CN2014/081622 filed Jul. 4, 2014 and relates to Chinese Patent Application No 201310303472.X filed Jul. 18, 2013, of which the disclosures are incorporated herein by reference and to which priority is claimed.

FIELD OF THE INVENTION

This invention is related to the field of mass spectrometric analysis, in particular to a tandem mass spectrometric analysis method realized in ion trap mass analyzer.

BACKGROUND ART

As a powerful analysis technology, mass spectrometry can realize qualitative and quantitative analysis of compounds, which is applied to such fields as pharmaceutical analysis, environment monitoring, national security, medical jurisprudence and proteomics. It is well known that tandem mass spectrometry (Tandem MS) is available for characterization and analysis of compound structure. Specific tandem mass spectrometric analysis process is stated as follows: The first stage aims at isolation, at which ions of certain mass-to-charge ratio (m/z) are selected from samples to be analyzed for isolation; isolated ions will become parent ions; the second stage aims at collision induced disassociation (CID); parent ions are to be in collision with neutral molecules of such gases as helium, argon and nitrogen; energy produced by collision is to be deposited on parent ions, and thereby enhance intrinsic energy of parent ions; eventually, parent ions will subject to fragmentation to obtain fragment ions; at the third stage, mass spectrometry peak of fragment ions is to be obtained through mass analysis to complete MS/MS analysis. In the event that ions of certain mass-to-charge ration are to be selected from fragment ions for isolation, they will be taken as parent ions to repeat aforesaid process until multi-stage mass spectrometric analysis is achieved. CID is the most extensive and comprehensive disassociation technology.

Among various spectrometers, quadrupole spectrometer and quadrupole ion trap spectrometer are recognized as the most appropriate devices for collision induced disassociation. Among them, quadrupole spectrometer is also known as quadrupole mass filer, which is only available for passing of ions of certain mass; therefore, numerous quadrupoles are to be spatially connected in series in case of tandem mass spectrometric analysis within the quadrupoles; normally, combination of three-stage quadrupoles, namely triple quadrupoles, is used. Triple quadrupole mass spectrometer is normally provided with larger area. Quadrupole ion trap (QIT) can execute such procedures as isolation, disassociation and mass analysis of ions in one trap, which enjoys unique advantages over tandem spectrometry.

According to its working principle, ion trap mass analyzer is expected to obtain movement status and results of ion of certain mass-to-charge ratio in the electric field based on solution to Mathieu quadratic linear differential equation set. Mathieu equation is obtained based on the fact that action of electric field on charged ions in ion trap is in compliance with Newton's Second Law, which aims to describe movement track and results of ions in quadrupole electric field. Taking 3D ion trap for instance, the following formula is obtained based on solution to Mathieu Equation:

$$a = \frac{16eU}{m(r_0^2 + 2z_0^2)\Omega^2},\ q = \frac{8\ \text{eV}}{m(r_0^2 + 2z_0^2)\Omega^2}$$

In the formula, a refers to a trap parameter in direct proportion to DC voltage; q refers to a trap parameter in direct proportion to radio voltage; U refers to DC voltage imposed on ion trap pole; V refers to radio frequency voltage imposed on ion trap electrode; Ω refers to frequency of radio frequency voltage; $r_0$ refers to radius of ring electrode; $z_0$ refers to axial radius. Ions of different mass-to-charge ratio escaped from ion trap are to be detected once alteration to electric field is made on ion trap electrode. Ions moving inside the ion trap are stable or within the stable area. Ions escaped from the ion trap are instable or outside of stable area. According to analysis based on stability diagram, ions of different mass-to-charge ratios will move out of the stable area in proper sequence under the action of electric field with sequential variations in case of mass analysis of ion trap; in other words, they are ejected from the ion trap and detected by ion detector outside of the trap to complete mass analysis.

Resonance excitation technology has become an ion ejection and disassociation approach widely applied to the ion trap after sustainable development for nearly 20 years. Normally, resonance excitation is realized by using a pair of electrodes in the ion ejection direction inside the ion trap to impose an auxiliary AC voltage, namely dipolar excitation voltage; such voltage is provided with specific frequency and amplitude; whereas voltage amplitude and frequency on the pair of electrodes are identical with phase difference up to 180°. Ion confined inside the ion trap are provided with a secular frequency (ω) under the action of radio frequency voltage; ions of different mass-to-charge ratio are provided with different secular frequencies. Interrelation between secular frequency and frequency (Ω) of radio frequency voltage is stated as follows:

$$\omega = \frac{\beta}{2}\Omega$$

β is a coefficient as well as a parameter as shown in stability diagram for ion trap; the two are mutually associated. When frequency of dipolar excitation voltage is identical to secular frequency of ion of certain mass-to-charge ratio, the ion is to subject to resonance to intensify its movement in the direction of dipolar excitation voltage; eventually, ion ejected from small hole or slit on the electrode is to be collected by the ion detector. When frequency of dipolar excitation voltage is deviated from secular frequency of ion of certain mass-to-charge ratio, resonance is still available despite of significantly reduced amplitude that is inadequate to eject the ion; under such circumstance, resonance of ion at low amplitude may result in intensified collision between ion and neutral gas molecules in the trap to complete collision induced disassociation. Frequency, amplitude and duration of dipolar excitation voltage may without exception affect results of collision induced disassociation. Resonance excitation technology still has its disadvantages and deficiencies despite of its relatively high fragmentation efficiency. The underlying reason is that only ions of certain fixed mass-to-charge ratio are available for resonance, and mass-to-charge ratio of fragment ions obtained through fragmentation is to be changed, namely increased or decreased; at this point, secular frequency of fragmentation ions is different from AC frequency, and is unavailable for resonance; in other words, as it is unavailable for further disassociation, fragment information as shown in the tandem mass spectrogram is to be restricted.

Non-patent literature 1 and 2 introduce a method used to realize tandem mass spectrometry; in other words, dipolar DC voltage is to be imposed on a pair of electrodes. When ion of certain mass-to-charge ratio is isolated, dipolar DC voltage is to be imposed; under the action of DC voltage, the ion is to be deviated from the trap center to accelerate its movement; meanwhile, radio frequency voltage still has certain heating effect on this ion. Eventually, it may result in significant increase in intrinsic energy of the ion and disassociation. As collision induced disassociation realized by dipolar DC voltage is not in resonance mode, which has no restrictions on mass-to-charge ratio of ion, ion may subject to further disassociation under the action of dipolar DC even if parent ion becomes fragmented; as a result of it, information on fragmentation peak as shown in tandem spectrogram will be more abundant; Different from conventional resonance excitation approach, collision induced disassociation driven by dipolar DC voltage is a non-resonance excitation approach that can obtain more abundant information on fragmentation ions; it is an important innovation on existing disassociation approach. However, such approach requires an additional DC power to supply DC voltage so as to provide dipolar DC voltage via the electric circuit, meanwhile, as dipolar DC voltage subject to sequential variation, and required precise control, it has more stringent and complicated requirements for hardware of instruments.

Non-patent literature 1: B. M. Prentice, W. Xu, Z. Ouyang, S. A. McLuckey, DC potentials applied to an end-cap electrode of a 3D ion trap for enhanced MSn functionality. International Journal of Mass Spectrometry 2011, 306, 114-122.

Non-patent literature 2: B. M. Prentice, S. A. McLuckey, Dipolar DC Collisional Activation in a "Stretched" 3-D Ion Trap: The Effect of Higher Order Fields on rf-Heating. Journal of the American Society for Mass Spectrometry 2012, 23, 736-744.

SUMMARY OF THE INVENTION

The purpose of this invention is to provide a tandem mass spectometry analysis method that can significantly simplify experimental devices and procedures.

Driving voltage for ion trap mainly refers to radio frequency (RF) voltage. Presently, radio frequency voltage driving ion trap is available in two types, namely conventional sine wave driving mode and digital square wave driving mode. Methods proposed by this invention is applicable to both working modes.

What described hereinafter is based on digital square wave. In the ion trap driven by digital square wave, preset amplitude of square wave used to restrict ions is normally up to several hundred voltage and remain a certain value. When ion trap is in operation, resonance ejection of ions is realized through scanning of square wave frequency. Similar to restricted square wave, dipolar excitation square wave used for resonance excitation of ions is generated and controlled in the same mode; nevertheless, its amplitude is relatively low, which is within 1 voltage; whereas its frequency is in the fixed proportion to restricted square wave. Both restricted square wave and dipolar excitation square wave used for ejection of ions belong to symmetrical wave; in other words both of them are provided with 50% duty ratio.

Parameters (a and q) similar to those used in Mathieu Equation are used to describe stability of ion trap for digital square wave. When an ion with mass and charge represented by m and e respectively moves within the pure quadrupole field, parameter (a and q) can be indicated as follows:

$$a_z = \frac{8eU}{mr_0^2\Omega^2},\ q_z = \frac{4\ \mathrm{eV}}{mr_0^2\Omega^2} \tag{1}$$

Wherein, $r_0$ refers to field radius of ion trap; whereas U, V and Ω refer to DC component, AC component and frequency of rectangular square wave respectively. Duty ratio of rectangular square wave during experiment according to this invention is 50% (square wave), which contains no DC component; therefore, U is equal to 0; whereas V is equal to 50% (half peak amplitude) of difference between high and low electrical level of square wave. Parameters of digital ion trap are mainly represented by value $q_z$ expressed as follows:

$$q_z = \frac{\mathrm{eV}T_{RWF}^2}{mr_0^2\pi^2} \tag{2}$$

Wherein, $T_{RWF}$ refers to cycle of digital rectangular square wave (restricted voltage); value $q_z$ for ion ejection is mainly affected by cycle of digital rectangular square wave. When voltage amplitude V of restricted square wave is fixed, it is applicable to obtain different values of $q_z$ by changing square wave cycle.

In digital ion trap, mass analysis is realized through scanning of frequency of square wave signals; to make sure that all ions can be ejected from the ion trap through resonance excitation at the same value $q_z$, frequency of resonance excitation signals is to be scanned in together with that of square wave signals. Resonance excitation signals may be produced through frequency division for square wave signals; if frequency division number is n, frequency $\omega_{exe}$ of resonance excitation signals will be:

$$\omega_{exe}\Omega/n \tag{3}$$

Interrelation between resonance frequency $\omega_s$ (secular frequency) and frequency Ω of numerically restricted voltage signals can be indicated with parameter $\beta_z$.

$$\omega_s=\beta_z\Omega/2 \tag{4}$$

When digitally restricted voltage signals are in square wave, the following relationship is to be established between $\beta_z$ and $q_z$.

$$\beta_z = \frac{1}{\pi}\arccos\left[\cos\left(\pi\sqrt{q_z/2}\right)\cosh\left(\pi\sqrt{q_z/2}\right)\right] \tag{5}$$

When frequency of external resonance excitation signals is equal to resonance frequency, ions subjecting to resonance are to be ejected from the ion trap; what obtained based on Formula (3) and (4) is stated as follows:

$$\beta_z=2/n \tag{6}$$

If frequency division number n is confirmed, it is applicable to make use of Formula (5) and (6) to calculate value $q_z$ indicated as $q_{ejection}^{o}$ when ion are ejected. At this point, mass-to-charge ratio of ions is indicated as follows:

$$m/e = \frac{V}{q_{ejection} r_0^2 \pi^2} T^2 \tag{7}$$

Wherein, T refers to cycle of digitally restricted voltage.

It can be seen that if amplitude V remains unchanged, linear scanning of frequency of digitally restricted voltage is not targeted at mass-to-charge ratio. It is applicable to carry out the following periodic scanning to realize linear scanning of mass-to-charge ratio: Set initial cycle of digitally restricted voltage as $T_{start}$, and wait for N cycles before increasing the cycle by a fixed step length $T_{step}$; under such circumstance, cycle of digitally restricted voltage is to be changed into Tstart+$T_{step}$. After that, wait for another N cycles before proceed with operation in the same manner. The following formula is to be obtained for any step in the process of scanning:

$$T_i = T_{start} + iT_{step} \tag{8}$$

$$t_i = \sum_{j=0}^{i-1} NT_j + T_i N/2 = (T_{step} i^2/2 + T_{start} i + T_{start}/2) \tag{9}$$

Wherein, $t_i$ refers to duration of step i based on intermediate time of step i (N/2 cycles for step i). It is applicable to eliminate variable i to obtained the following formula through based on simultaneous equation (8) and (9):

$$T_i = \sqrt{T_{start}^2 - T_{start} T_{step} + (2T_{step}/N) t_i} \tag{10}$$

$T_i$ refers to cycle of digitally restricted voltage corresponded when ion is ejected from the ion trap. It can be seen that mass-to-charge ratio is linear relationship with time once $T_i$ is introduced into Formula (7); in other words, linear scanning of mass-to-charge ratio of ion is achieved.

In the event that either digital square wave or sine wave voltage is used to restrict ions in the ion trap, it is essential to impose a dipolar excitation voltage when ions are ejected from the ion trap by means of resonance excitation; in other words, an AC voltage of the same amplitude and contrary phase is imposed on one pair of electrodes in the ion trap to eject ions in the direction of electrodes.

In view of aforesaid theoretical basis, this invention provides a tandem mass spectrometric analysis method in the ion trap mass analyzer, it is divided into three stages as represented by selective isolation of ions, collision induced disassociation as well as mass scanning and analysis; wherein:

At the said stage of selective isolation of ions, selected ions are isolated; whereas isolated parent ions are confined in the ion trap, subjecting to collision with neutral gas molecules and cooling under the action of electric field produced by working voltage in the ion trap;

At the said collision induced disassociation stage, ions of certain mass-to-charge ratio are provided with higher energy, subjecting to resonance excitation by ions with certain cycle or frequency through alteration to cycle of ion excited radio frequency voltage signals imposed on the electrode of ion trap or frequency of ion excited radio frequency voltage imposed on the ion trap or ion resonance excitation cycle; under the action of cycle, energized parent ions are to be excited for disassociation through collision with neutral molecules in the ion trap; as a result of it, fragmentation ions produced are to be confined through cooling in the ion trap for further mass analysis.

At the said mass scanning and analysis stage, amplitude of restricted voltage remains unchanged, and its cycle subjects to linear scanning in a direction from small to large to realize linear scanning of mass-to-charge ratio of ions following collision induced disassociation of ions; fragment ions will subject to resonance excitation under the action of dipolar excitation voltage; eventually, they are to be discharged from lead-out hole or groove of ion extraction electrode to capture mass spectrometry signals, subjecting to detection on ion detector outside ion trap.

Specific contents involved at the said collision induced disassociation stage are further described as follows:

At this stage, amplitude of digitally restricted radio frequency voltage, duty ratio, cycle of digitally restricted radio frequency voltage selected as well as initial and final cycles remain unchanged; further select one certain frequency division number n, namely value β (n=β/2) indicating frequency relationship between ion excited and digitally excited radio frequency voltage; in view of relationship with value β, cycle of radio frequency voltage subjecting to ion resonance excitation is changed; whereas duty ratio remains unchanged; accompanied by variation to radio frequency voltage subjecting to ion resonance excitation, collision energy is to be produced through resonance among ions.

According to this invention, parent ions selected for isolation are to be restricted by electrical field produced by digitally restricted radio frequency working voltage to realize appropriate increase in neutral cooling gas passing into the ion trap and collision energy at the said collision induced disassociation stage.

According to this invention, wave form used to impose ion excited radio frequency voltage signals belongs to sine wave voltage or digital square wave voltage or other wave forms at the said collision induced disassociation stage.

According to this invention, cycle of digitally restricted radio frequency voltage is altered and regulated as per experimental requirements at the said collision induced disassociation stage.

According to this invention, frequency and amplitude of digitally restricted radio frequency voltage is set at the said collision induced disassociation stage.

According to this invention, ratio between ion excited radio frequency voltage and digitally restricted radio frequency voltage is random.

As tandem mass spectrometric analysis method of this invention has no requirements for varieties of ion trap, it is applicable to select 3D ion trap or rectangular ion trap comprising 2D linear ions and various structures or ion trap array or field regulated ion trap and so on.

According to tandem mass spectrometric analysis method of this invention, the time for alteration to the cycle of dipolar excitation voltage signals is not restricted, which can be several or several hundred milliseconds; its duration is determined by experimental demands.

According to tandem mass spectrometric analysis method of this invention, mass analysis of fragment ions is realized in the form resonance excitation; mass analysis mode will not affect results of tandem mass spectrometry analysis.

Advantage of the method according to this invention lies in the fact that it can obtain ion collision energy by changing the cycle through control of the software, and thereby realize disassociation; it can significantly simplify experimental devices and procedures.

DESCRIPTION OF DRAWINGS

Indication number in the FIG: 1—ion source, 2—guide rod, 3—detector, 4—ion trap, 5—mechanical pump, 6—turbopump, 7—cooling gas

PREFERRED EMBODIMENTS

Embodiment 1

Figure 1:
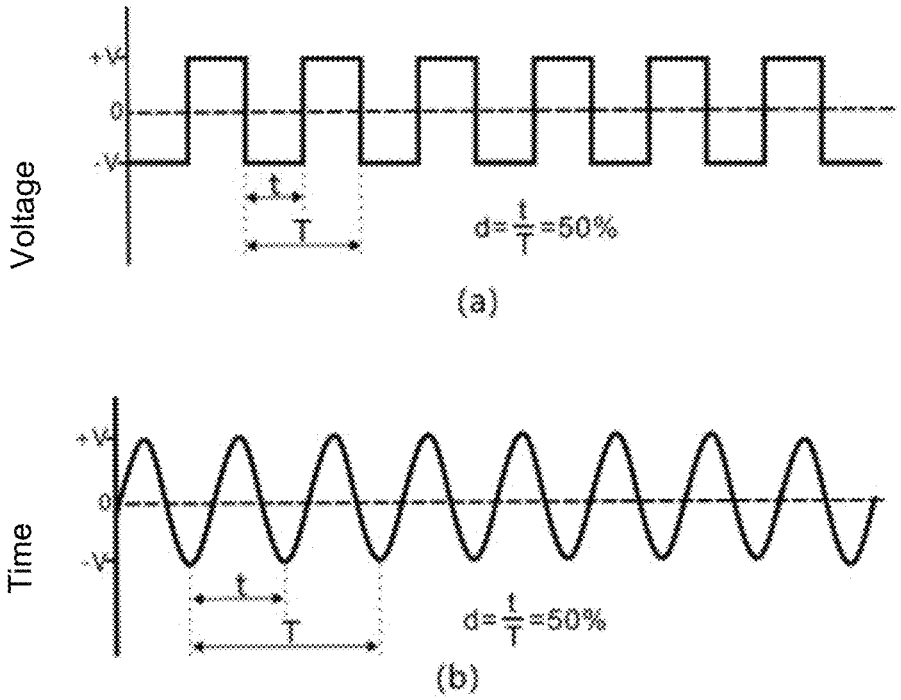
FIG. 1 is the wave form diagram for square wave and sine wave driving ion trap; wherein, (a) and (b) are wave form diagrams for symmetrical square wave and sine wave respectively.
Figure 2:
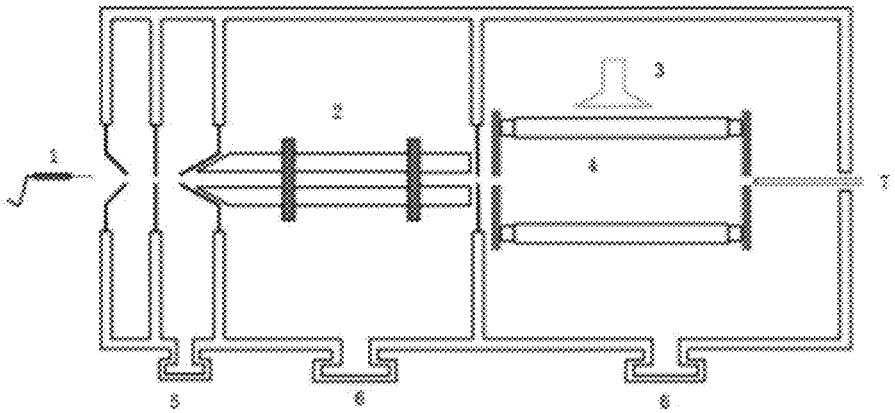
FIG. 2 is the structural diagram for experimental platform of instrument according to Embodiment 1.

This technical solution makes use of digital square wave to drive ion trap, which is expected to realize collision induced disassociation by changing cycle of dipolar excitation voltage; experimental verification has been carried out to this solution, of which specific contents are stated as follows:

According to this solution, rectangular ion trap is selected for test. Instrument experiment platform is as shown in FIG. 2, which comprises electrospray ionization source-rectangular ion trap mass spectrometry system (ESI-RIT-MS) independently designed and fabricated by our laboratory. This instrument comprises three-stage differential vacuum system; vacuity inside the third-stage vacuum cavity where ion trap is located is up to $3\times10^{-3}$ Pa. ions produced by electrospray ionization source come into the two-stage vacuum cavity via the sampling cone, which will be further delivered to the rectangular ion trap by a 200 mm long quadrupole ion to complete mass analysis. Helium, the cooling gas is to be introduced from the small hole on the electrode of rear cover of the ion trap for cooling of ions. Reagent used is Reserpine (m/z=175) that is made into $5\times10^{-5}$ M solution by Shanghai Aladdin Reagent Co., Ltd; selected solvent is 50:50 methanol, containing 0.05% acetic acid.

Figure 3:
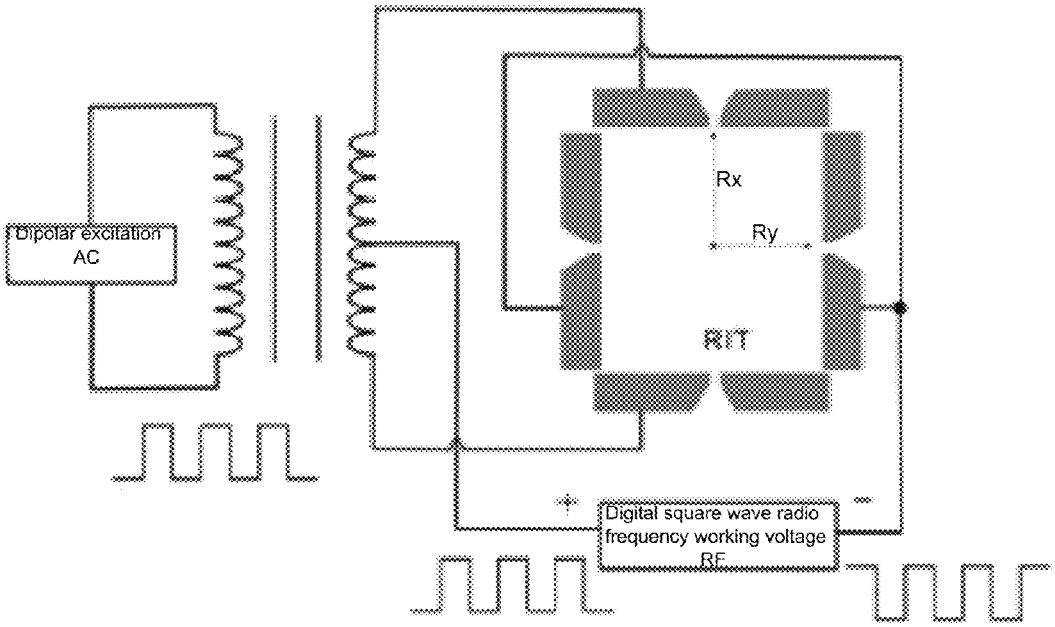
FIG. 3 is the diagram for ion restricted square wave voltage and dipolar excitation square wave voltage imposed according to Embodiment 1.

Square wave voltage of low electrical level, namely 5V TTL electrical level is to be produced by means of direct digital synthesis (DDS). Continuously adjustable high-voltage square wave with amplitude of 0-500 $v_{0\text{-}p}$, is obtained through amplification with quick switches and MOSFET field effect tube, which is to be used as restriction voltage. Dipolar excitation voltage is to be obtained through frequency division of restriction voltage; in other words, there exists a proportional relationship between frequency of dipolar excitation voltage and that of restriction voltage; the coefficient is β/2, wherein value β is lower than 1. in other words, it is applicable to further change cycle of dipolar excitation voltage signals by changing restriction voltage signals. Cycle, sweep rate, symmetry and time sequence is available for precise control with software. The mode in which square wave voltage is imposed on rectangular ion trap is as shown in FIG. 3. A pair of square wave restricted voltage of the same amplitude and thoroughly different phase is to be imposed on two pairs of electrodes in the Direction x and y of ion trap. Ions are ejected in the direction x; whereas coupled dipolar excitation voltage and square wave restricted voltage is imposed to a pair of electrodes in direction x.

It is applicable to obtain a complete spectrogram of sampled ions through conventional mass scanning. Under such circumstance, dipolar excitation voltage is in symmetrical wave form with frequency equivalent to ⅓ of that of restricted square wave; in other words, value β is ⅔; whereas amplitude is a set value. Accompanied by scanning of frequency of restriction square wave, ions of different mass-to-charge ratios will subject to resonance at the resonance point in proper sequence, which will be detected by ion detector one ejected from the ion trap. Tandem mass spectrometry analysis is divided into three stages in terms of time.

Figure 4:
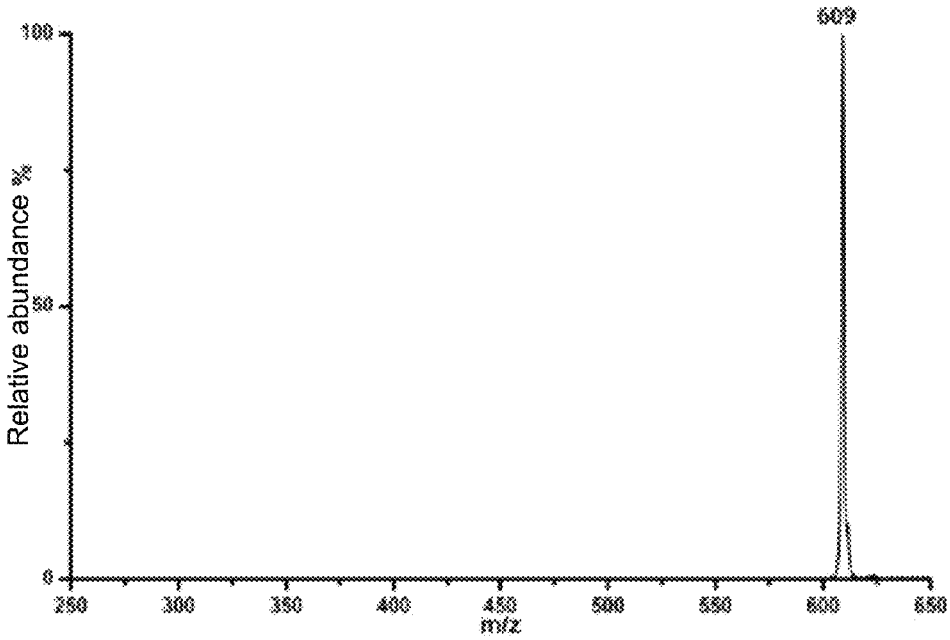
FIG. 4 is the mass spectrogram showing experimental results and selective isolation of parent ions according to Embodiment 1; selected sample is Reserpine (m/z=609).

At the first stage of tandem mass spectrometric analysis, Reserpine ion is to be isolated for cooling before being restricted in the ion trap; under such circumstance, dipolar excitation voltage is not imposed. At this point, mass scanning is to be carried out following this stage to obtain a spectrogram comprising 609 mass spectral peaks as shown in FIG. 4.

At the second stage of mass spectrometric analysis, cycle of restriction voltage is to be further changed by changing that of dipolar excitation voltage; meanwhile, such voltage is in symmetrical wave form; its duty ratio is 50%; whereas its amplitude remains unchanged. Value β is a certain value lower than 1; under the action of periodic change of dipolar excitation voltage, parent ion will subject to disassociation to obtain fragment ions to be restricted through cooling. Cycle of restriction voltage signals is changed by software.

At the third stage of tandem mass spectrometric analysis, dipolar excitation voltage is in symmetrical wave form; in other words, duty ratio is 50%, and value β is ⅔. Fragment ions will subject to resonance under the action of dipolar excitation voltage; eventually, fragment ions ejected from the lead-out hole or groove on the electrode are to be detected to complete tandem mass spectrometric analysis.

Figure 5:
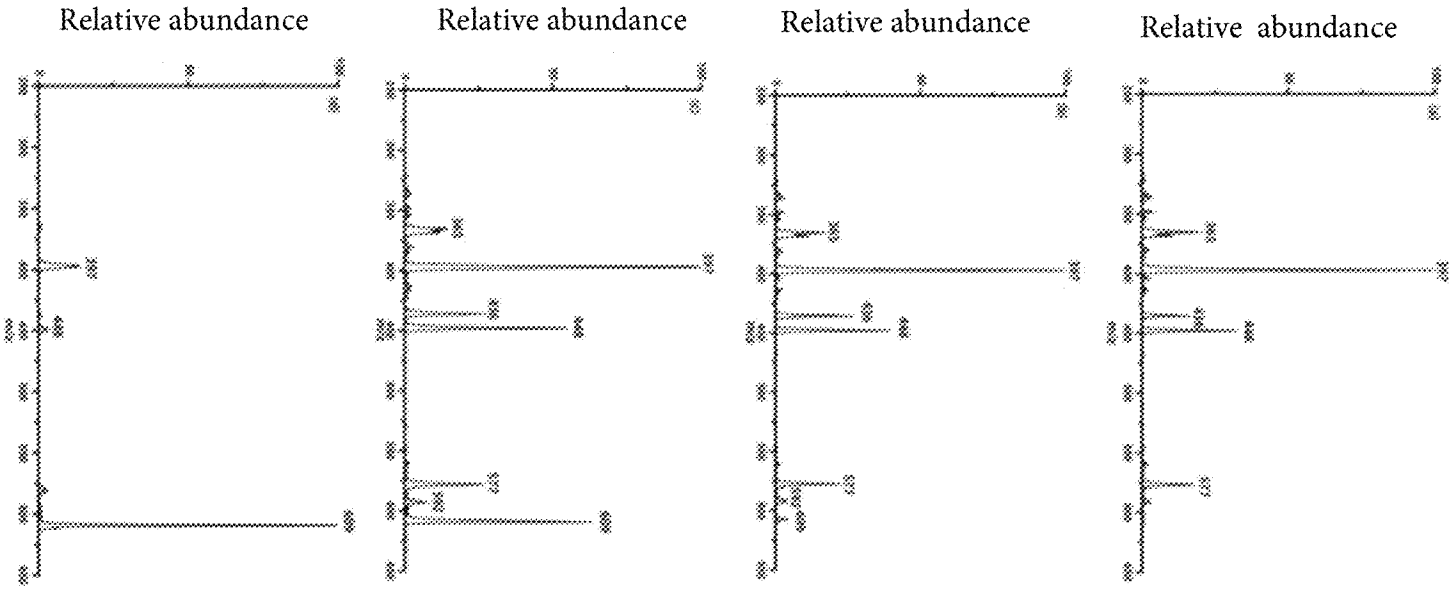
FIG. 5 is the mass spectrogram showing experimental results of Embodiment 1 and collision induced disassociation realized by resonance collision of ions through change of cycle of square wave voltage; value β is 0.3478; duration is 40 ms; cycle (a), (b), (c) and (d) is 1.450 μs, 1.46 μs, 1.465 μs and 1.470 μs respectively.

As indicated by preliminary experimental results, at the second stage of tandem mass spectrometric analysis, namely collision induced disassociation stage, parent Reserpine ions will subject to fragmentation to some extent when value β is fixed to 0.3478, and the cycle of restriction voltage signals is up to 1.450 μs, 1.460 μs, 1.465 μs and 1.470 μs respectively. See FIG. 5(*a*)-(*d*).

Figure 6:
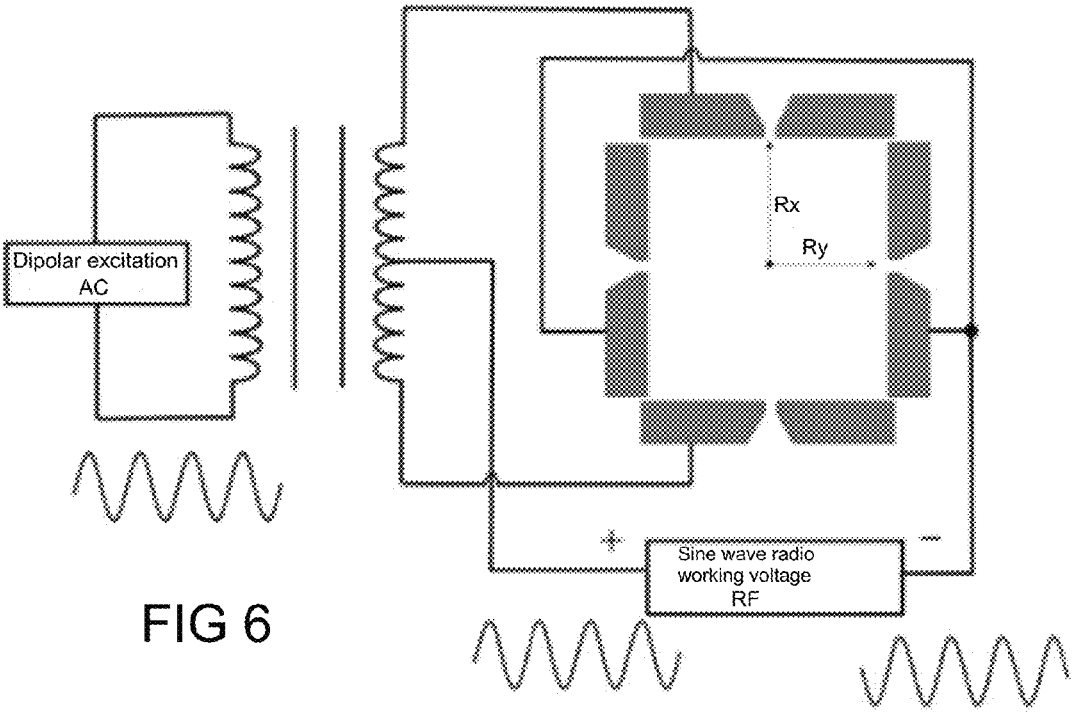
FIG. 6 is the diagram showing conventional sine wave voltage used to drive ion trap and dipolar excitation voltage imposed in the same manner as ion restricted voltage and dipolar excitation voltage when sine wave is used.

According to this invention, it is applicable to use conventional sine wave voltage to drive ion trap; sine wave is also applicable to dipolar excitation voltage; it is also applicable to make use of resonance collision energy of ions produced by changing cycle of dipolar excitation voltage to realize collision induced disassociation of parent ions. Radio frequency voltage and dipolar excitation voltage imposed are as shown in FIG. 6.

Figure 7:
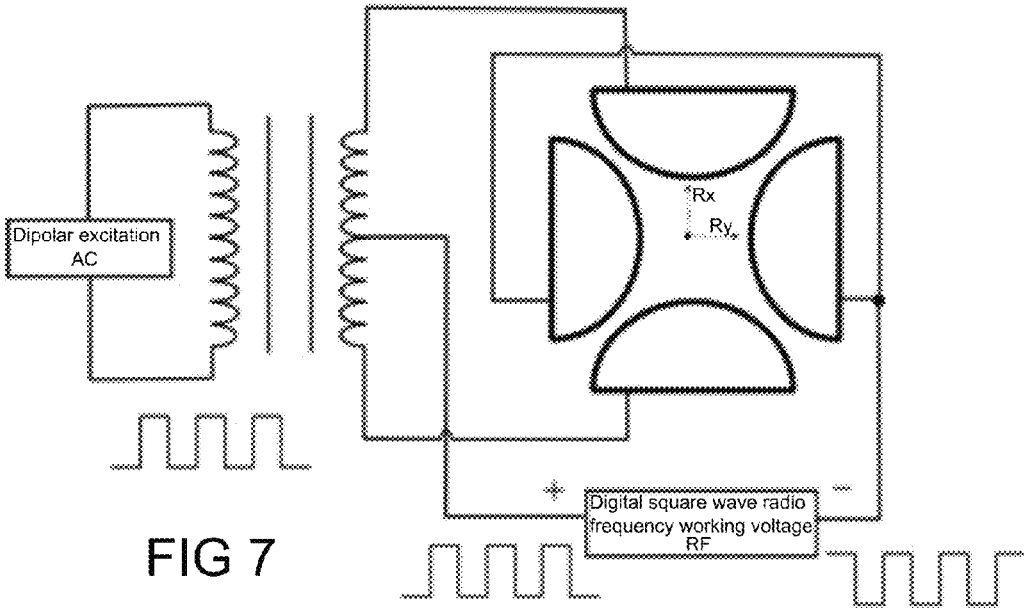
FIG. 7 is the diagram showing digital square wave voltage used to drive ion trap and dipolar excitation voltage imposed in the same manner as ion restricted voltage and dipolar excitation voltage when digital square wave is used.

According to this invention, ion trap with hyperbolic electrodes is used; it is applicable to select 3D ion trap or linear ion trap with hyperbolic electrodes; central sectional structure of the two is identical; radio frequency voltage and dipolar excitation voltage imposed are as shown in FIG. 7; it is also applicable to impose a pair of digital square wave voltage of the same amplitude and thoroughly different phase to two pairs of electrodes in direction x and y of hyperbolic ion trap respectively; this aims to realize collision induced disassociation of parent ions by changing cycle of dipolar excitation voltage signals.

The invention claimed is:

1. A tandem mass spectrometric analysis method in an ion trap mass analyzer, comprising three stages as represented by selective isolation, collision induced disassociation and mass scanning of ion in proper sequence, wherein:

selected parent ion is to be isolated at said stage of selective isolation of ion; whereas parent ion isolated is to be confined in the ion trap through collision with neutral gas molecules and cooling under the action of electric field produced by working voltage in ion trap;

at said collision induced disassociation stage, cycle of ion excited radio frequency voltage signals imposed on the ion trap pole is changed, to further change cycle of radio frequency voltage produced by resonance excitation of ion; as a result of it, ion of certain mass-charge ratio is to be provided with higher energy, subjecting to resonance excitation by ion excited radio frequency voltage of certain cycle or frequency; ion subjecting to resonance excitation is to be disassociated to generate fragment ion through collision with neutral molecules in ion trap; fragment ion subjecting to cooling in ion trap is to be confined for follow-up mass analysis;

at said mass scanning and analysis stage, ion in ion trap is to subject to resonance excitation under the action of dipolar excitation voltage as imposed on the electrode of ion trap: eventually, it is to be discharged from lead-out bole or groove of ion extraction electrode to capture mass spectrometry signals, subjecting to detection on ion detector outside ion trap, wherein voltage amplitude and duty ratio of digital bound radio voltage remain unchanged at said stage of collision induced disassociation; cycle of digital radio voltage is to be selected while its initial and final cycle value remain unchanged; further select a certain frequency division number n, namely frequency relation β between cycle of ion excited radio voltage and digital bound radio voltage ($n=\beta/2$); in view of relation with value β, cycle of ion resonance excited radio voltage is to be changed while duty ratio remains unchanged; accompanied by variation to ion resonance excited radio voltage, collision energy is to be produced through resonance motion among ions.

2. The tandem mass spectrometric analysis method according to claim 1, wherein mass-to-charge ratio is to subject to linear scanning at said mass scanning and analysis stage.

3. The tandem mass spectrometric analysis method according to claim 1, wherein wave form of ion excited radio voltage signals imposed is digital square wave or sine wave at said stage of collision induced disassociation.

4. The tandem mass spectrometric analysis method according to claim 1, wherein neutral cooling gas delivered to ion trap is to be supplemented at the said stage of collision induced disassociation.

5. The tandem mass spectrometric analysis method according to claim 1, wherein frequency and amplitude of digital bound radio voltage are in constant value at said stage of collision induced disassociation.

6. The said tandem mass spectrometric analysis method according to claim 1, wherein the frequency ratio between ion excited radio voltage and digital bound radio voltage is random at the said stage of collision, induced disassociation.

7. The tandem mass spectrometric analysis method according to claim 1, wherein said ion trap is a 3D or 2D linear ion trap.

8. The tandem mass spectrometric analysis method according to claim 1, wherein said ion trap is ion trap array or field regulated ion trap.

* * * * *